US006213135B1

(12) United States Patent
Moulder

(10) Patent No.: US 6,213,135 B1
(45) Date of Patent: Apr. 10, 2001

(54) LINKAGE ASSEMBLY FOR CLEANING TANKCARS

(76) Inventor: Jeffrey Ernest Moulder, P.O. Box 1104, New Caney, TX (US) 77357

( * ) Notice: Subject to any disclaimer, the term of this patent is extended or adjusted under 35 U.S.C. 154(b) by 0 days.

(21) Appl. No.: 09/578,624

(22) Filed: May 25, 2000

Related U.S. Application Data

(60) Provisional application No. 60/135,983, filed on May 25, 1999.

(51) Int. Cl.[7] ..... B08B 9/093
(52) U.S. Cl. ..... 134/167 R
(58) Field of Search ..... 134/167 R, 168 R; 239/227

(56) References Cited

U.S. PATENT DOCUMENTS 5,352,298 10/1994 Moulder ..... 134/22.18
5,518,553 5/1996 Moulder ..... 134/22.18
5,720,310 2/1998 Moulder ..... 134/167 R
6,021,793 2/2000 Moulder ..... 134/167 R

FOREIGN PATENT DOCUMENTS

538928 * 2/1977 (SU) ..... 134/167 R

* cited by examiner

*Primary Examiner*—Philip R. Coe
(74) *Attorney, Agent, or Firm*—Harrison & Egbert

(57) ABSTRACT

A linkage assembly apparatus is provided for cleaning stubborn and hazardous deposits and residues from the interior surfaces of tankcars. This Linkage assembly is configured to be inserted through a tankcar manway and then properly positioned and operated without human operator intervention. A plurality of hingedly interconnected link members travel upon rollers along an integrated boot-like track guide to position a spray head and attached nozzle-pair in close proximity to the various surfaces being cleaned using high-pressure water. The arrangement of each of the plurality of hingedly interconnected link members is designed to limit bending thereof in only one direction.

9 Claims, 5 Drawing Sheets

LINKAGE ASSEMBLY FOR CLEANING TANKCARS

RELATED APPLICATIONS

This application claims priority based upon Provisional U.S. Application Ser. No. 60/135,983 filed May 25, 1999.

FIELD OF THE INVENTION

The present invention relates to cleaning apparatus and associated methods and, more particularly, relates to improved techniques for cleaning and rinsing the interior surfaces of railway tank cars and the like, without the need for human entry thereinto.

BACKGROUND OF THE INVENTION

It is well known in the prior art that a diversity of commodities are transported by land in railway tank cars, truck trailers, transport tankers, etc. Railway tank cars typically are constructed with a single manway entry disposed atop and at the longitudinal center thereof. Prior to being filled or loaded with a particular commodity, such a tank car must be throughly cleaned or rinsed, depending upon the circumstances, for health and safety reasons. Such cleaning and rinsing operations have heretofore been not only labor-intensive and time-consuming, but also hazardous.

It is also well known in the art that there frequently are stubborn deposits contained on the interior surfaces including the bulkheads and floor of tank cars and the like which necessitate the use of a high pressure fluid spray to dislodge such deposits. Typically, to accurately direct such high pressure fluid spray to successfully dislodge deposits and the like, manual intervention is required. As will, of course, be appreciated by those skilled in the art, having a worker enter a tank car through a manway and then spray the various interior surfaces of the tank car under limited maneuverability and lighting conditions subjects the worker to dangers of skin, eye, nose and throat irritation or poisoning attributable to unknown chemicals and contaminants, suffocation from fumes, and physical injury due to slippery surfaces and foreign obstacles and the like, and even from explosions.

There have been several improvements in the art to provide different varieties of robotic means or similar apparatus to improve the methodology for cleaning and washing the interior surfaces of tank cars and the like. For instance, the instant inventor disclosed a robotic apparatus for cleaning and stripping tank cars and the like in U.S. Pat. Nos. 5,352,298; 5,518,553; 5,720,310; and 6,021,793. While these cleaning devises teach minimal human intervention and have proven to be useful in the marketplace, circumstances arise for which only providing high-pressure hydroblastins or the like at close proximity to the surfaces being cleaned is capable of purgings stubborn, entrenched tank residues or the like. It will be appreciated by those skilled in the art that such intense hydroblasting via "hand-gunning" is inherently difficult to orchestrate remotely through a tank car manway.

As will be understood by those skilled in the art, since tank cars are typically approximately 40 feet long, it is necessary to extend any cleaning head at least 20 feet from the manway in order to accomplish effective cleaning operations in the absence of entry by a human operator. To accomplish such a demanding cleaning task, a cleaning apparatus must be designed to have the inherent ability to fully reach with a high pressure blast-head—from a manway—all of the interior surfaces of a tank car and the like. A cleaning device affording these capabilities has hereinbefore been unknown in the art.

Accordingly, these limitations and disadvantages of the prior art are overcome with the present invention, and improved cleaning means and techniques are provided which are useful for remotely and robotically cleaning and washing the interior surfaces of tank cars and the like.

SUMMARY OF THE INVENTION

In a preferred embodiment of the present invention, there is provided a linkage assembly apparatus for cleaning stubborn and hazardous deposits and residues from the interior surfaces of tankcars and the like. This linkage assembly is configured to be inserted through a tankcar manway and then properly positioned and operated without human operator intervention. The arrangement of each of the plurality of hinged interconnected link members is designed to limit bending thereof in only one direction along a boot-like track or travel guide.

Accordingly, it is an object of the present invention to provide an apparatus for cleaning railway tankcars and the like under conditions in which the interior surfaces are populated by stubborn and hazardous residues and deposits.

It is another object of the present invention to provide an apparatus for cleaning railway tankcars and the like under conditions in which the interior surfaces are populated by stubborn and hazardous residues and deposits, without requiring human intervention.

It is yet another object of the present invention to provide an apparatus for cleaning railway tankcars and the like under conditions in which the interior surfaces are populated by stubborn and hazardous residues and deposits, without requiring the apparatus to contact the tankcar floor.

It is still another object of the present invention to provide a linkage apparatus with a plurality of hinge members that are structured to be bent in only one direction.

These and other objects and features of the present invention wilt become apparent from the following detailed description, wherein reference is made to the figures in the accompanying drawings.

IN THE DRAWINGS

DETAILED DESCRIPTION

Figure 1:
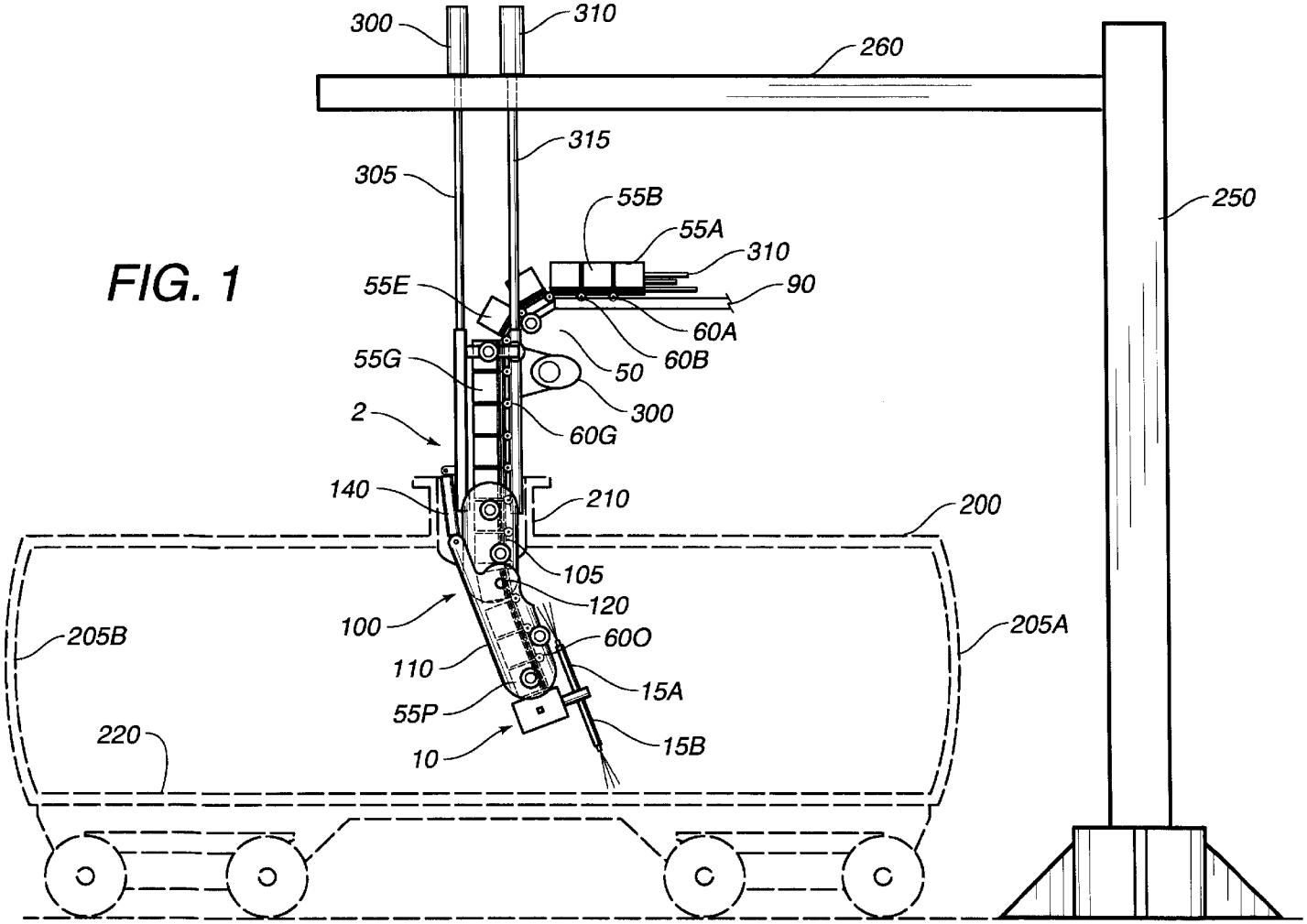
FIG. 1 is a simplified frontal perspective view of an embodiment of the present invention being inserted into a railway tank car through the manway.
Figure 2:
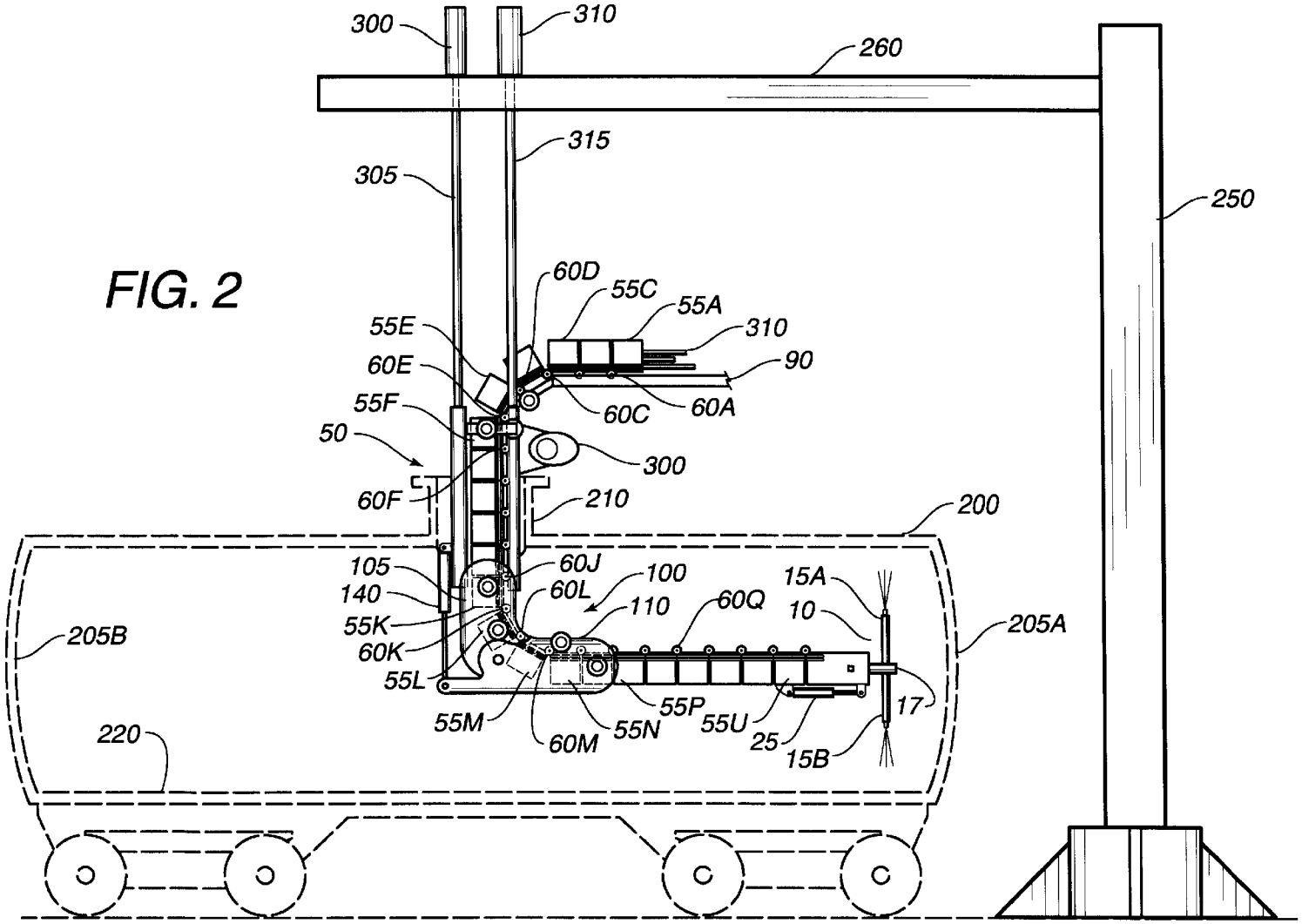
FIG. 2 is a simplified frontal perspective view of the embodiment depicted in FIG. 1 after being inserted into a railway tank car through the manway and being oriented toward an end of the tank car.

Now referring to FIGS. 1 and 2, there is depicted a simplified frontal perspective view of linkage assembly embodiment 2 of the present invention. As will be hereinafter described in detail, embodiments of the apparatus contemplated by the present invention may be secured to a support structure wherein tankcars and the like may be situated thereunder and cleaning operations conducted.

More particularly, FIG. 1 depicts linkage assembly 2 being inserted into railway tank car 200 through manway 210. Also shown are bulkheads 205 A and B of tank car 200. Linkage assembly 2 is fixedly attached to platform 260 which is, in turn, secured to support structure 250. As wilt be appreciated by those skilled in the art, linkage assembly 2 is configured in an extended, substantially linear arrangement with cleaning or spray head 10 disposed linearly at the remote end thereof, wherein linkage assembly 2 may be easily lowered into tank car 200 through manway 210 under the influence of a plurality of hydraulic or preferably pneumatic cylinders 300 and 310, or the like, in a manner well known in the art.

Thus, according to the present invention, a worker may be situated upon platform 260 and then remotely control the action of cylinders 300 and 310 upon corresponding pistons 305 and 315, respectively, so that assembly 2 with intertinked plurality of members 55A, 55B, etc. may be lowered halfway to approximately the center of tankcar 200. Plurality of hoses 310 communicate water or another suitable washing liquid from an external source (not shown) to remotely disposed washing head member 10. As will, be understood by those skilled in the art, since the present invention has been designed to effectively clean all of the interior tankcar surfaces under adverse conditions in which stubborn and hazardous residue populates such interior surfaces, it is advantageous for a cleaning apparatus not to rest upon the tank car floor. Accordingly, during the entry step, apparatus 2 is lowered to mid-height of tankcar 200 from top track guide 90. As will be hereinafter described, another cylinder is provided for performing positioning functions including establishing the optimum height of the lower portion of apparatus 2 relative to tankcar floor 220.

Figures 3A, 3B:
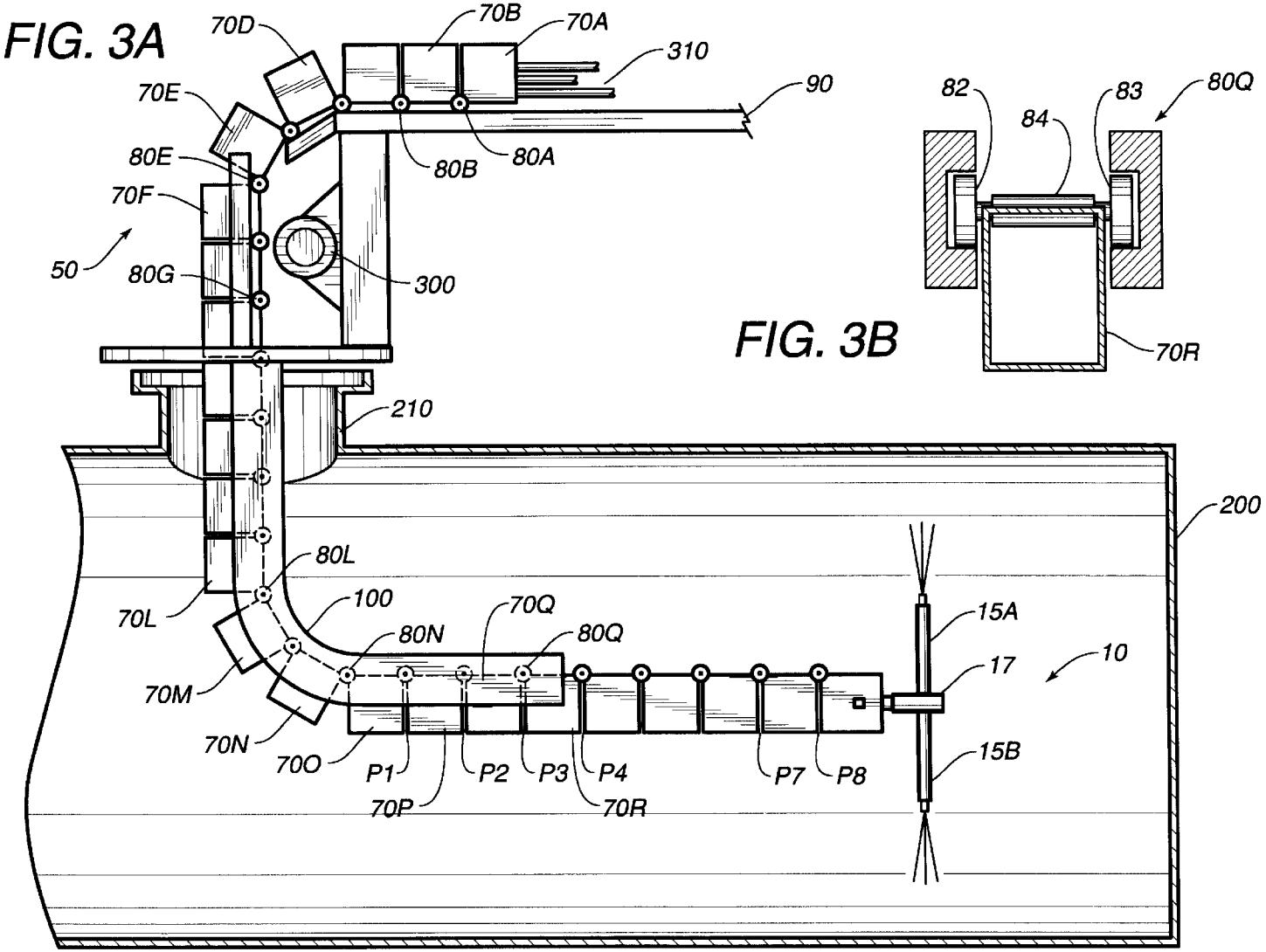
FIG. 3A is a simplified frontal view of an embodiment depicted in FIG. 2 after being oriented toward an end of the tank car.
FIG. 3B is a right side cross-sectional view of the embodiment depicted in FIG. 3A.
Figures 4A, 4B:
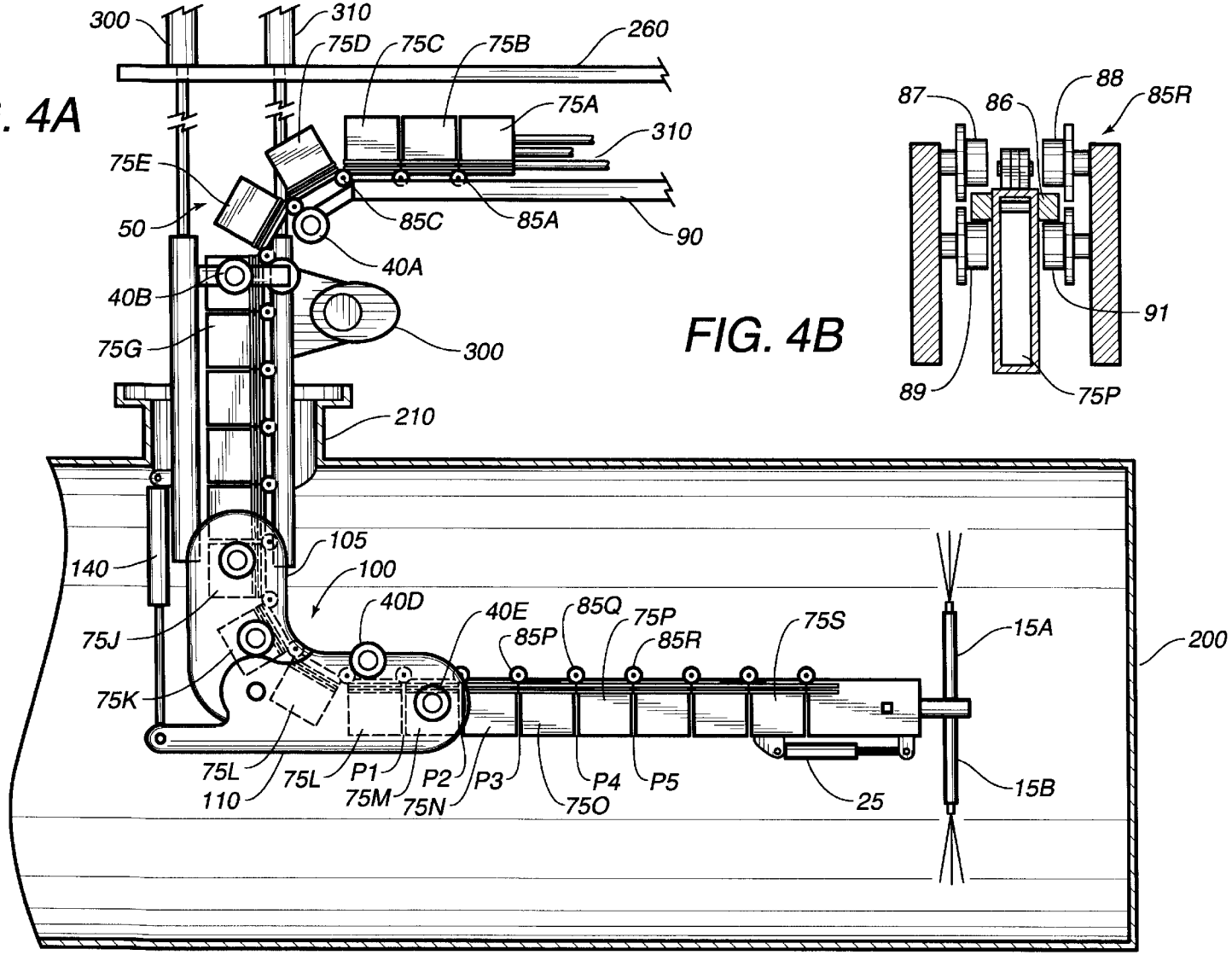
FIG. 4A is a detailed frontal view of another embodiment of the present invention.
FIG. 4B is a right side cross-sectional view of the embodiment depicted in FIG. 4A.
Figure 5A:
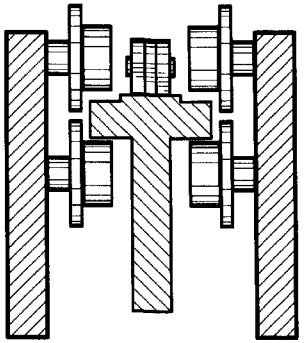
FIG. 5A is a right side cross-sectional view of the embodiment depicted in FIG. 4A, but having T-Beam configured link members.
Figure 5B:
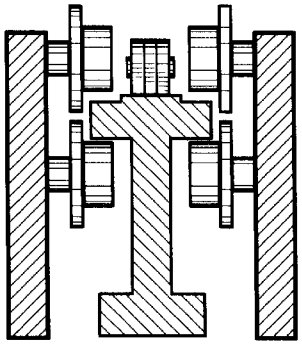
FIG. 5B is a right side cross-sectional view of the embodiment depicted in FIG. 4A, but having I-Beam configured link members.
Figure 5C:
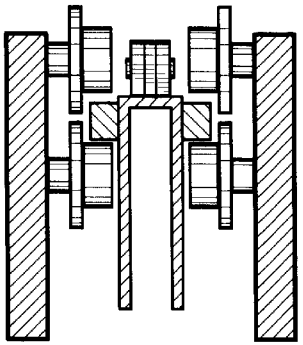
FIG. 5C is a right side cross-sectional view of the embodiment depicted in FIG. 4A, but having channel configured link members.
Figure 5D:
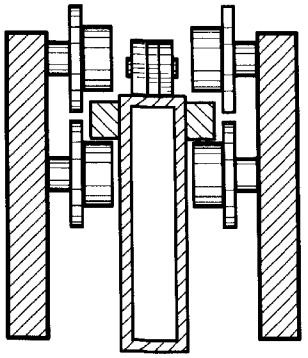
FIG. 5D is a right side cross-sectional view of the embodiment depicted in FIG. 4A, having rectangular tubing configured link members as depicted in FIG. 4B.
Figure 5E:
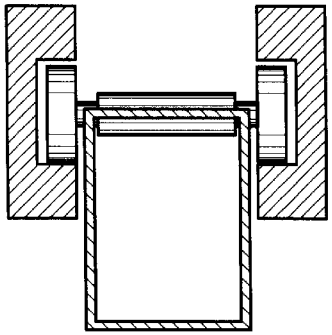
FIG. 5E is a right side cross-sectional view of the embodiment depicted in FIG. 3A, having square tubing configured link members as depicted in FIG. 3B.
Figure 5F:
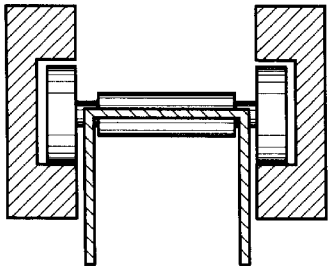
FIG. 5F is a right side cross-sectional view of the embodiment depicted in FIG. 3A, but having Angle Iron configured link members.

Referring now to FIG. 2, after being inserted through manway 210, linkage assembly 2 is shown in a configuration in which cleaning or spray head 10 has been articulated horizontally toward right bulkhead 205A. As will become evident to practitioners in the art, the end result of this articulation step, as illustrated in FIGS. 2, 3A, and 4A, is for bottom portion 30 of the linkage assembly of the present invention to be firmly suspended in a substantially horizontal position, thus being disposed in a substantially parallel relationship with tank car floor 220.

As shown in FIG. 2, boot-shaped member 100 provides a bending guide means for causing the plurality of chained members 50 to be property oriented to address each side of tankcar 200. More particularly, boot guide member 100 comprises upper boot portion 105 pivotally attached at pivot 120 to lower boot portion 110. It will be understood that, under the action of boot cylinder 140, lower portion 110 is caused to pivot about 120 to thereby conform to a substantially horizontal position parallel to tankcar floor 220. Then, based upon upper boot member 105 being perpendicular to lower boot member 110, the linkage portion of plurality of links 50 that pass through boot guide member 100 are caused to form a like arrangement. Thus, linkage chain 50 is seen in FIG. 2 as comprising a top horizontal portion of linked members 55A–C, first transition portion of linked members 55D–E, medial vertical portion of linked members 55F–K, second transition portion of linked members 55L–M, and bottom horizontal portion of linked members 55N–U. This top horizontal portion of linked members 55A–C includes hinge members 60A–C; first transition portion of linked members 55D–E includes hinge members 60C–E, medial vertical portion of linked members 55F–K includes hinge members 60E–K, second transition portion of linked members 55L–M includes hinge members 60K–M, and bottom horizontal portion of linked members 55N–U includes hinge members 60M–U.

It will become clear to those skilled in the art that the present invention provides an apparatus that, after being suspended substantially horizontally amid a tankcar or the like, enables proximal interior surfaces to be pressure-sprayed as a rotating spray nozzle means travels at the remote end of an interlinked chain whose motion is dictated by a novel boot guide member. As depicted in FIG. 2, spray head member 10 is disposed proximal to bulkhead 205A wherein nozzles 15A–B may pressure wash all of the proximal interior surfaces of tankcar 200.

Cleaning head cylinder 25 enables the disposition of nozzles 15A–B to be remotely controlled so that their proximity to the neighboring surfaces may be fine-tuned and so that any and all internal configurations and obstacles may be readily accommodated. The disposition of cleaning head 10 relative to tankcar floor 220 may also be fine-tuned using boot cylinder 140. It will be understood that under the influence of hydraulic motor 300, receiving water-feed through hose member 310, controls the linear movement of spray head member 10 from the center of tankcar 200—beneath manway 210—to either bulkhead 205A or B, and the reverse, if appropriate to thoroughly accomplish the cleaning task at hand. It will also be appreciated that the speed of movement should be judiciously selected to be commensurate with the intensity and nature of the residue and deposits being washed.

Now referring to FIGS. 3A–B and 4A–B, there are depicted alternative structures contemplated by the present invention for successfully performing close-up pressure-washing of the interior surfaces of tankcars and the like under adverse conditions. In FIGS. 3A–B, there is depicted an embodiment of the present invention in which plurality of bearing rollers are mounted on the links or joints. In FIGS. 4A–B, on the other hand, there is depicted an embodiment of the present invention in which plurality of bearing rollers are mounted on the boot guide means. Thus, for this latter embodiment, each hinge member 60*i* corresponds to not only a hinge means but also a bearing roller pair.

Now referring specifically to FIGS. 3A–B, there is shown the structure of this embodiment that enables movement of plurality of chained link members 50 into and longitudinally across tankcar 200. As clearly depicted in FIG. 3B, link member 70R disposed in the bottom substantially horizontal portion of the plurality of chained link members, is constructed with a square cross-section and pivotally attached to the track guide by hinge member 80Q. Hinge member 80Q comprises hinge means 84 with pair of bearing rollers 82 and 83 mounted to link member 70R.

Referring now specifically to FIGS. 4A–B, there is shown the structure of an alternative embodiment that enables movement of plurality of chained link members 50 into and longitudinally across tankcar 200. As clearly depicted in FIG. 4B, link member 75P disposed in the bottom substantially horizontal portion of the plurality of chained link members, is constructed with a rectangular cross-section and pivotally attached to the track guide by hinge member 85R. Hinge member 85R comprises hinge means 86; two pair of bearing rollers 87, 88 and 89, 91 are each mounted to guide member 100. It will be appreciated that, while this embodiment requires two roller bearing pair for each link member, it could deliver a relatively light structure inasmuch as the weight of the probing joints multiplies as the linkage chain extends farther from the point of support toward the tankcar bulkhead. It will be appreciated that, while this embodiment requires a roller bearing pair for each link member, it could deliver a relatively light structure inasmuch as the weight of the probing joints multiplies as the linkage chain extends farther from the point of support toward the tankcar bulkhead.

The present invention teaches a linkage assembly comprising plurality of chained hinge members for enabling close-proximity, thorough cleaning of inherently stubborn, hazardous residues and deposits from all of the interior surfaces of railway tankcars in a manner heretofore unknown in the art. As has been described, each of these individual passive structural joints is hinged on one side to allow the linkage structure taught by the present invention to bend in only one direction from essentially a linear disposition. Hence, as illustrated in FIGS. 3A and B, by using the forces due to gravity and the constraints afforded via boot-like guide 100, each of the cube-shaped link members 70*i*, i.e., 70A, 70B, 70C, etc., stay erect horizontally so long as each of corresponding hinge members 80*i*, i.e., 80A, 80B, 80C, etc., is disposed on top. As the bottom of adjacent link members make contact with each other, bending is inherently prevented and support to each another is obtained. It will also be appreciated that the weight of blast head 10 is sustained. This plurality of contact points is depicted as P1 for contact between link members 700 and 70P; P2 for contact between link members 70P and 70Q; P3 for contact between link members 70Q and 70R; etc.

Similarly, as illustrated in FIGS. 4A and B, by using the forces due to gravity and the constraints afforded via boot-like guide 100, each of the cube-shaped link members 75*i*, i.e., 75A, 75B, 75C, etc., stay erect horizontally so long as each of corresponding hinge members 85*i*, i.e., 85A, 85B, 85C, etc., is disposed on top. As the bottom of adjacent link members make contact with each other, bending is inherently prevented and support to each another is obtained. It will also be appreciated that the weight of blast head 10 is sustained. This plurality of contact points is depicted as P1 for contact between link members 75L and 75M; P2 for contact between link members 75M and 75N; P3 for contact between link members 75N and 75O; P4 for contact between link members 75O and 75P; etc.

It should be clear to those skilled in the art that the chain of Links of the present invention are forced either up or down the bending guide or track means by a hydraulic motor means or the like. Of course, any number of link members may be used in the chain depending upon the extent of prerequisite reach into the tankcar interior. Storage of unused link members is achieved on the upper portion of the track guide.

It should be evident to those skilled in the art that the hinge means contemplated by the present invention preferably includes or is complemented by roller bearings to assure smooth transition throughout the different portions of the track guide means. Each link member benefits from the features afforded by built-in roller guides that cooperate with the boot-like track. That is, the weight of each link member and the supported structure are accommodated on the plurality of rollers that predictably travel within the confines of the implicated track or guide. Under the influence of the motor means, such linked members easily travel through a boot-guide determined curved path to reach the interior surfaces of a tankcar. Simple cam rollers have been found to perform satisfactorily as contemplated hereunder.

FIGS. 3A–B and 4A–B disclose alternative embodiments of the one-way bending joints contemplated by the present invention. Other configurations of the hinge means are also within the teachings of the present invention. Various acceptable cross-section configurations of hinge means are illustrated in FIGS. 5A–F. Thus, while the embodiment illustrated in FIGS. 3A–B is shown with square tubing (see FIG. 5E), another embodiment could be constructed with joints having Angle Iron (see FIG. 5F). Similarly, while the embodiment illustrated in FIGS. 4A–B is shown with rectangular tubing, other embodiments could be constructed with joints having a modified T-beam (see FIG. 5A), I-beam (see FIG. 5B), or channel (see FIG. 5C). It will be appreciated that, as hereinbefore described, it is important for such hinge means embodiment to be offset as far as possible from the point of contact of successive joints.

Referring now to FIGS. 3A and 4A, it is seen that spray head member 10 includes pivot member 17 for permitting the tilting action of T-bar configuration manifest by plurality of nozzles 15A and B. In particular, permitting such tilting during high-pressure water spray in close-proximity to the interior surfaces tends to reduce the likelihood of creating byproduct thrust or backlash. It will be understood that by properly positioning the spray nozzles, latent thrust is essentially equalized so that wavering or predictable behavior of the probe means of the present invention has been avoided particularly at the bulkheads. It should be clear that reversing the hydraulic motor returns the link members from the bulkhead back to the central manway region at a rate commensurate with the difficulty of the cleaning task at hand. When the probe assembly has returned to its fully retracted position, pivot means 17 actuates T-bar spray nozzles 15A–B into a streamlined configuration and boot cylinder 140 actuates boot pivot 120 to achieve a streamline configuration of upper boot portion 105 and lower boot portion 110. Once this linear alignment has been achieved, of course, the apparatus of the present invention may be lifted from the tankcar through the manway.

Using the structures taught by the present invention it has been found that all of the interior surfaces of railway tankcars and the like may be thoroughly cleaned using high-pressure hydro blasting delivered at close proximity to these surfaces. For a tankcar typically approximately 40 feet long, embodiments of the present invention use roller guided travel to extend the built-in distal cleaning head C at least 20 feet from a central man. It has been found that, by using 24 cubic inch rated hydraulic motor, embodiments of the present invention typically travels at an average rate of ¾ inch per revolution. A revolution nominally takes about 6 seconds. It has been further found that a typical range of rates of travel, depending upon the nature of the deposits and residues being cleaned, is from ½ inch per revolution to 1 inch per revolution. This cleaning operation may be achieved by extending the link apparatus of the present invention from the manway toward the bulkhead, by retracting it from the bulkhead toward the manway, or both. All such operations may take about 2–3 hours for completion and are achieved remotely of the tankcar with no necessity for entry into the tankcar by a worker. It will be appreciated that to use conventional manual methods to accomplish such cleaning usually takes about 6–8 hours and, under exigent circumstances, may take as long as 2–3 weeks because of safety concerns, OSHA considerations, and the like.

Accordingly, instead of performing cleaning of tankcars and the Like using a wheeled robotic vehicle as is known in the art, the present invention teaches a remote-controlled chain-linkage apparatus that provides for cleaning at close proximity throughout the tank interior with high pressure hydro blast without the need for human entry. Indeed, the present invention negates the need of a human worker ever touching the tank.

Other variations and modifications will, of course, become apparent from a consideration of the structures and techniques hereinbefore described and depicted. Accordingly, it should be clearly understood that the present invention is not intended to be limited by the particular structures and methods hereinbefore described and depicted in the accompanying drawings, but that the concept of the present invention is to be measured by the scope of the claims herein.

What is claimed is:

1. For a tankcar having a plurality of interior surfaces including a floor, side walls, bulkhead and a ceiling having a manway for access of a worker thereinto, and disposed near an external support structure, a cleaning apparatus comprising:

a platform fixedly attached to said support structure;

a plurality of hingedly interconnected link members stored upon said platform;

boot guide means fixedly attached to said support structure and configured to receive said plurality of hingedly interconnected link members;

a spray head means fixedly attached at a remote end of said plurality of hingedly interconnected link members adapted to spray high-pressure water from an external source to a proximal surface of said plurality of interior surfaces; and alignment means for streamlining the configuration of said boot guide means and said spray head means for enabling said to be inserted into said tankcar through said manway and for enabling said boot guide means to be articulated and positioned for directing said high-pressure spray against said proximal surface.

2. The cleaning apparatus recited in claim 1, wherein said boot guide means comprises a first boot guide member pivotally attached to a second boot guide member.

3. The cleaning apparatus recited in claim 2, wherein said alignment means disposes said first boot guide member and said second boot guide member in linear relationship for insertion of said cleaning apparatus through said manway.

4. The cleaning apparatus recited in claim 3, wherein said alignment means dispose said first boot guide member and said second boot guide member in a perpendicular relationship for disposing a bottom portion of said plurality of hingedly interconnected link members in a parallel relationship with said manway floor.

5. The cleaning apparatus recited in claim 4, wherein said alignment means disposes said spray head means in linear relationship for insertion of said cleaning apparatus through said manway.

6. The cleaning apparatus recited in claim 5, wherein said alignment means enables fine-tuning of said disposition of thereof relative to said proximal surface.

7. The cleaning apparatus recited in claim 6, wherein said plurality of hingedly interconnected link members is adapted to permit adjacent link members to bend in only one direction.

8. The cleaning apparatus recited in claim 7, wherein said plurality of hingedly interconnected link members are forced to travel within said boot guide means by an hydraulic motor affixed thereto.

9. The cleaning apparatus recited in claim 8, wherein said cleaning head means comprises pivotable nozzle means.

* * * * *